US005220388A

United States Patent [19]

Kato

[11] Patent Number: 5,220,388

[45] Date of Patent: Jun. 15, 1993

[54] METHOD OF AND APPARATUS FOR TRANSFERRING TONER IMAGES

[75] Inventor: Keishi Kato, Kanagawa, Japan

[73] Assignee: Fuji Photo Film Co., Ltd., Kanagawa, Japan

[21] Appl. No.: 634,781

[22] Filed: Jan. 11, 1991

Related U.S. Application Data

[63] Continuation of Ser. No. 256,360, Oct. 11, 1988, abandoned.

[30] Foreign Application Priority Data

Oct. 8, 1987 [JP] Japan ..... 62-254102

[51] Int. Cl.[5] ..... G03G 15/16

[52] U.S. Cl. ..... 355/279; 355/280; 355/290

[58] Field of Search ..... 355/279, 285, 289, 290, 355/280

[56] References Cited

U.S. PATENT DOCUMENTS

| | | | |
|---|---|---|---|
| 2,221,776 | 11/1940 | Carlson | 355/285 X |
| 3,685,896 | 8/1972 | Kaupp | 355/290 X |
| 3,904,875 | 9/1975 | Rees et al. | 355/285 X |
| 4,754,294 | 6/1988 | Kato | 346/160 |
| 4,780,742 | 10/1988 | Takahashi et al. | 355/290 |
| 4,863,543 | 9/1989 | Shiozawa et al. | 156/235 |
| 4,891,677 | 1/1990 | Shiozawa et al. | 355/280 |

*Primary Examiner*—Fred L. Braun

*Attorney, Agent, or Firm*—Sughrue, Mion, Zinn, Macpeak & Seas

[57] ABSTRACT

A method of transferring toner images carried by an photoconductive layer to a image receiving sheet having an adhesion layer thereon transfers the toner image by putting the adhesion layer of the transfer sheet into contact with the photoconductive layer. The adhesive layer is made of a material which is softened and becomes adhesive upon exposure to heat or light, and is subjected to heat or light when the image receiving sheet is put into contact with the photoconductive layer to transfer the toner image on the photoconductive layer onto the image receiving sheet. The apparatus includes a moving device which moves the image receiving sheet having the adhesion layer, the adhesion layer being formed of a material sensitive to either heat or light, and which is adhesive only upon heat or light being applied thereto. A transferring device transfers the toner images onto the adhesion layer, and an adhesive softening device softens the adhesion layer. The toner images are transferred to the image receiving sheet when the adhesion layer contacts the photoconductive layer.

9 Claims, 2 Drawing Sheets

METHOD OF AND APPARATUS FOR TRANSFERRING TONER IMAGES

This is a continuation of application Ser. No. 07/256,360, filed Oct. 11, 1988, now abandoned.

BACKGROUND OF THE INVENTION

1. Field of the Invention

This invention relates to a method of transferring a toner image formed on a photoconductive material by an electrophotographic method onto a substrate, and more particularly to an adhesion transfer method using an image receiving sheet having an adhesion layer.

2. Description of the Prior Art

Heretofore, there has been known an electrophotographic copying machine or an electrophotographic printer in which an electrostatic latent image is formed by irradiating a uniformly charged photoconductive material with a light beam which is modulated by an image signal. By use of toner, the electrostatic latent image is developed into a toner image, and then the toner image is transferred to a substrate such as paper.

Various electrophotographic methods have been proposed which are capable of recording continuous tone images with a high degree of reproducibility. For example, in the applicant's Japanese Patent Publication No. 49(1974)-38172 there is disclosed an electrophotographic method, in which a toner image, which has been developed from a latent image formed on a photoconductive material, is transferred to a final substrate by use of an adhesion tape or adhesion sheet. This adhesion sheet is hereinafter referred to as an image receiving sheet. The image receiving sheet is first attached to the toner image, then peeled off and adhered to a final substrate.

A method using a corotron is widely employed to electrostatically transfer a toner image formed on a photoconductive material onto a substrate such as paper. This method, however, is known to be disadvantageous in that it has poor transfer efficiency for the high and low density portions of the toner image. In contrast thereto, the so-called adhesion transfer method, in which the toner image is transferred by use of an image receiving sheet coated by a layer of adhesive material, which layer is hereinafter referred to as the adhesion layer, is advantageous in recording a continuous toner image because its transfer efficiency is extremely high regardless of the image density.

In the conventional adhesion transfer method, an image receiving sheet is generally used, in which the adhesion layer has viscosity and therefore adheres at room temperature. This type of image receiving sheet is used with a release sheet applied thereon, and therefore means for peeling the release sheet off the image receiving sheet before transferring the toner image to said sheet, and means for taking up the peeled off release sheet are needed. Because of inclusion of these means, the apparatus becomes complicated, large and relatively expensive when compared to the apparatus using a corotron.

Further, it is necessary to attach said final substrate, which may be a transparent sheet, onto the adhesion layer after the transfer of the toner image is finished so as not to damage the adhesion layer and so as to prevent the adhesion layer from sticking to fingers or the like. The means for attaching the final substrate, or transparent sheet, to the adhesion layer also contributes to the overall largeness of the system.

SUMMARY OF THE INVENTION

Accordingly, the primary object of the present invention is to provide a method of adhesion transfer which is free from the problems described above.

More specifically, the object of the present invention is to provide a method of adhesion transfer in which the adhesion layer of the image receiving sheet does not adhere at room temperature, and accordingly there is no need to attach a release sheet to the adhesion layer, which simplifies the structure of the copying machine or printer and saves the expense of providing a means for peeling off the release sheet and a means for taking up the peeled off release sheet.

The adhesion transfer method according to the present invention is characterized in that the adhesion layer is made from a material which becomes adhesive only when it is exposed to heat or light, whereby the image receiving sheet has adhesive properties only when it is applied to the photoconductive material.

Since the image receiving sheet according to the present invention begins to adhere or becomes sticky only when it is applied to the photoconductive material, there is no need to attach a release sheet thereon and the image receiving sheet can be handled just like normal paper. Further, after the transfer of the image is completed and the heat or light is removed, the adhesion layer hardens, has no viscosity and no longer exhibits adhesive properties. Therefore, it is not necessary to attach the image receiving sheet to a transparent sheet which acts as a final substrate.

DESCRIPTION OF PREFERRED EMBODIMENTS

Now the present invention will be described in detail with reference to the accompanying drawings.

Figure 1:
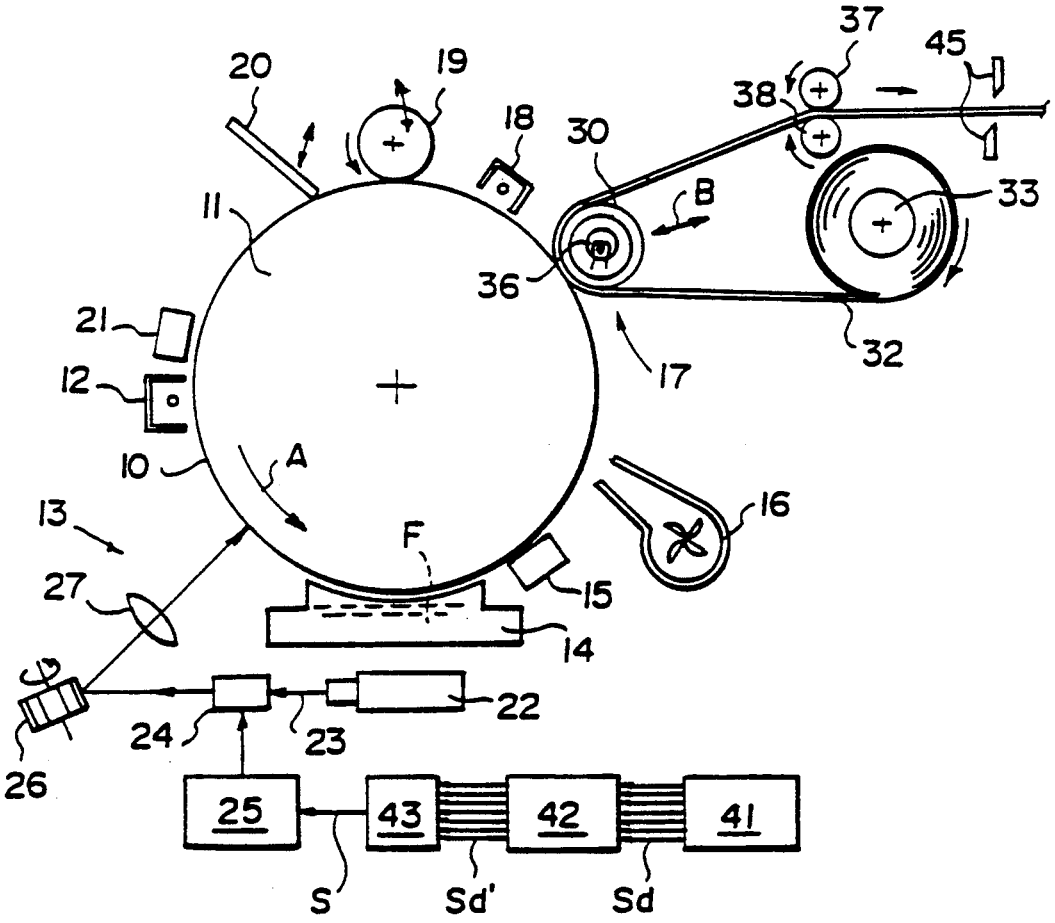
FIG. 1 is a schematic view showing an example of an apparatus for carrying out the method of this invention.

FIG. 1 shows an example of an electrophotographic printer which carries out toner image transfer with the adhesion transfer method of the present invention. A photosensitive drum 11, provided on its surface with a photoconductive layer 10, is rotated in the direction of arrow A by a driving means not shown in the drawing. The following means are located around the photosensitive drum 11, and they are arranged in the order given when travelling in the direction of arrow A: a charger 12, an exposure means 13, a wet type developer 14, a squeezing apparatus 15 such as a corona discharger or a squeezing roller, a drum drying fan 16, an adhesion transfer means 17, an electric charge remover 18, a cleaning roller 19, a cleaning blade 20 and an erasing lamp 21.

The exposure means 13 is constituted of a laser beam source 22 such as a laser diode or a He-Ne laser, a light modulator 24, such as an AOM (acoustooptic modulator), for amplitude-modulating the laser beam emitted by the laser beam source 22, a modulating circuit 25 for driving the light modulator 24, a light deflector 26 such as a polygon mirror for reflecting and deflecting the modulated laser beam 23, and a scanning lens 27 consisting of an fθ lens for focusing the light beam 23 into a uniform beam all of which means cause the laser to scan the photoconductive layer 10 with the beam substantially perpendicular to the direction of rotation of the photosensitive drum 11.

Further, an adhesion transfer means 17 is composed of a hollow pressure roller 30 which is movable by a means, which is familiar to one of ordinary skill in the art, in the directions indicated by double arrow B between a first position where it is in pressure contact with the photoconductive layer 10 on the periphery of the photoconductive drum 11 and a second position where it is separated from the photoconductive layer 10, an image receiving sheet supply roller 33 which stores an image receiving sheet 32 wound up thereon, and a heating lamp 36 provided within the pressure roller 30. The image receiving sheet 32 consists of, for example, white paper coated on one side with a transparent thermosensitive adhesion layer, as described hereinafter. The image receiving sheet 32 is wound partly around the pressure roller 30 with the adhesion layer facing outwardly and is fed by feed rollers 37 and 38. Rollers 37 and 38 may be a pair of nip rollers, which are rotated by driving means not shown in the direction shown by arrows When the images are recorded, the photosensitive drum 11 is rotated as described hereinbefore. Further, the heating lamp 36 within the pressure roller 30 is turned on in order to make the surface temperature of the pressure roller 30 higher than that at which the thermosensitive adhesion layer of the image receiving sheet 32 changes state (the temperature at which the thermosensitive adhesion layer softens and becomes sticky). A digital image signal Sd carrying a continuous tone image is forwarded from an image signal supplier 41 to a correction table 42, where it is converted to a corrected image signal Sd'. Correction table 42 corrects the gradation. The signal Sd' passes through the D/A converter 43 and is transformed into analog signal S. Signal S is then sent to the modulator 25. The modulator 25 drives light modulator 24 and amplitude-modulates the laser beam 23 in accordance with the image signal S.

By the rotating of the photosensitive drum 11, the photoconductive layer 10 is moved with respect to the charger 12 and is uniformly charged thereby. The uniformly charged photoconductive layer 10 is irradiated by a laser light beam 23 which has been deflected by the light deflector 26. The light deflector 26 causes the laser beam 23 to scan the photoconductive layer 10 in a first dimension (main scanning), and the rotation of the photosensitive drum 11 causes the laser beam 23 to scan the photoconductive layer 10 in a second dimension (subscanning), whereby the photoconductive layer 11 is two dimensionally scanned by the laser beam 23. As mentioned above, the laser beam 23 is modulated based on the image signal S, and accordingly an electrostatic latent image of the image carried by the image signal S is formed on the photoconductive layer 10 as it is irradiated by the laser beam 23.

The electrostatic latent image is developed by the wet type developer 14 into a toner image. The wet type developer 14 carries out the toner development by having a liquid developer F, which is composed of an insulating liquid and fine charged toner particles dispersed therein, contact the surface of the photoconductive layer 10 so that the toner particles are attracted to the photoconductive layer 10 by an electrostatic attractive force. The toner image thus obtained has densities proportional to the surface voltage of the latent electrostatic image which is formed by irradiating the modulated laser beam, so that a continuous density spectrum in the toner image contains the density gradations of the original image. After the development, the photosensitive drum 11 is dried by the corona discharger 15 which squeezes the drum 11 the drum drying fan 16.

Figure 2:
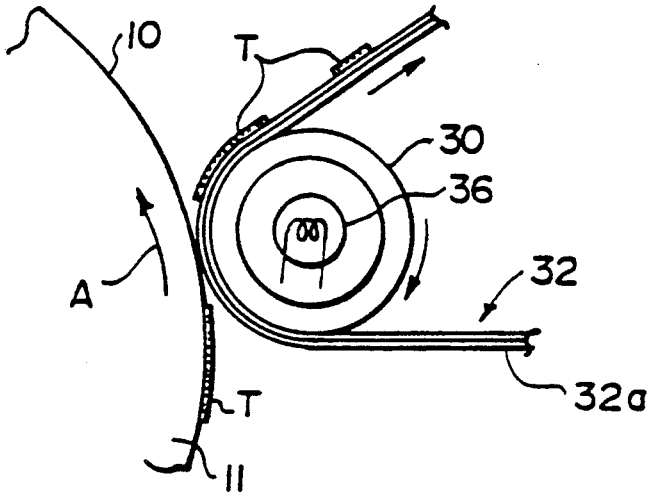
FIG. 2 is a side view showing in an enlarged scale part of said apparatus.
Figure 3:
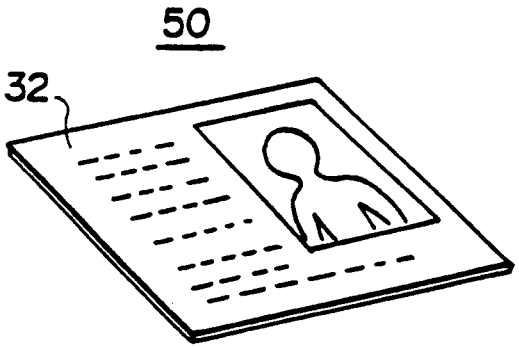
FIG. 3 is a perspective view showing an example of a print obtained by the toner image transfer according to the present invention.

When it is detected or determined by known means that the toner-developed part of the photoconductive layer 10 has come to the position immediately before the position where it is opposed to the pressure roller 30, the pressure roller 30 which has been separated from the photosensitive drum 11 is moved into pressure contact with the the photosensitive drum 11, and simultaneously the feed rollers 37 and 38 are driven. By the movement of the pressure roller 30, the thermosensitive adhesion layer side of the image receiving sheet 32 is put into contact with the photoconductive layer 10. The pressure roller 30 follows the rotation of the photosensitive drum 11, and the feed rollers 37 and 38 are rotated to move the image receiving sheet 32 at the same speed as that of the photoconductive layer 10 in pressure contact therewith. At this time, the image receiving sheet 32 is heated by the pressure roller 30 maintained at the proper temperature and the thermosensitive adhesion layer thereof is softened. Accordingly, as shown in detail in FIG. 2, the toner T on the photoconductive layer 10 is taken up onto the thermosensitive adhesion layer 32*a*. Hence, while the transfer sheet 32, which has taken up the toner image from the photoconductive layer 10, is fed to the feed rollers 37 and 38, the thermosensitive adhesion layer 32*a* is cooled and hardens. Then, the image receiving sheet 32 which has passed through the feed rollers 37 and 38 is cut by a cutter 45 (FIG. 1) into pieces for every image formed region. Thus, as shown in FIG. 3, a print 50 which carries an image formed by making toner adhere to an image receiving sheet 32 is obtained. On the print 50 (FIG. 3), since the thermosensitive adhesion layer 32*a* (FIG. 2) is already hardened as mentioned above, the image will not be ruined or damaged even if it is touched by fingers or the like, nor will the surface of the print stick to fingers or the like.

After the toner image is transferred, the electric charge on the photoconductive layer 10 is removed by the charge remover 18 (FIG. 1). Then, the photoconductive layer 10 is cleaned by the cleaning roller 19 and the cleaning blade 20. Further, the remaining latent image is erased by the erasing lamp 21 so that the photoconductive drum is reused for successive image recording processes.

The thermosensitive adhesion layer 32*a* may be made of an adhesive generally called hot-melt adhesive. The hot-melt adhesive contains a thermoplastic resin, a tackifier and a wax as its ingredients. Ethylene-vinyl acetate copolymer, polyethylene, atactic polypropylene, ethylene-ethyl acrylate copolymer, polyamide, saturated copolymerized polyester resin and the like can be used as a thermoplastic resin. Natural resins like rosin, derivatives thereof and pinene-type resins, and synthetic resins like aliphatic copolymers, aromatic copolymers, aliphatic-aromatic copolymers and coumarone-indene resin can be used as a tackifier. As a wax, paraffin wax, microcrystalline wax, low-molecular polyethylene wax, α-olefin wax, modified wax and the like can be used. Further, instead of this kind of thermosensitive adhesion layer, it is possible in the present invention to use an image receiving sheet having an adhesion layer which is softened and becomes adhesive by exposure to light.

Further, when the toner image on the photoconductive layer 10 is transferred to the thermosensitive adhesion layer 32*a*, since the toner T on the photoconductive layer 10 agglomerates with the application of heat, the toner image T is wholly taken up onto the adhesion layer 32*a* and accordingly hardly any of it remains on the photoconductive layer 10. Therefore, the transfer efficiency of the toner image is enhanced to provide a print 50 of high quality. This is also the case where an image receiving sheet having a photosensitive adhesion layer is used. In such a case, by using light having a comparatively long wavelength, the toner on the photoconductive layer 10 is heated and agglomerates as mentioned above.

The present invention has been described with reference to an embodiment applied to an electrophotographic printer for recording images of a continuous tone. However, it is possible to apply the adhesion transfer method according to the present invention to other systems, such as the recording or copying of a black-and-white binary value images.

I claim:

1. A method of transferring toner images carried by a photoconductive layer to an image receiving sheet having an adhesion layer thereon by putting the adhesion layer of the image receiving sheet into contact with a photoconductive layer, said method comprising the steps of:

making said adhesion layer of a material which softens and becomes adhesive only upon exposure to heat or light, said entire adhesion layer softening and becoming adhesive upon exposure to heat or light at a point of contact with said photoconductive layer; and subjecting said adhesion layer to heat or light only at the time when said adhesion layer is put into contact with the photoconductive layer so that a developed toner image is transferred from said photoconductive layer to said adhesion layer, said adhesion layer hardening upon said developed toner image being transferred to said adhesion layer to provide a final, non-tacky substrate, wherein said adhesion layer moves at a same speed as said photoconductive layer when said adhesion layer is in contact with said photoconductive layer.

2. A method of transferring toner images carried by a photoconductive layer to an image receiving sheet having an adhesion layer thereon, said method comprising the steps of:

making said adhesion layer of a material which softens and becomes adhesive only upon exposure to heat, said entire adhesion layer softening and becoming adhesive upon exposure to heat at a point of contact with said photoconductive layer;

subjecting said adhesion layer to heat only when said image receiving sheet contacts said photoconductive layer so that a developed toner image is transferred from said photoconductive layer to said image receiving sheet; and forming said adhesion layer of a material comprising a hot-melt adhesive, said adhesion layer hardening upon said developed toner image being transferred to said adhesion layer to provide a final, non-tacky substrate, wherein said adhesion layer moves at a same speed as said photoconductive layer when said adhesion layer is in contact with said photoconductive layer.

3. A method of transferring toner images as defined in claim 2, wherein said forming step comprises forming said hot-melt adhesive of a material comprising a thermoplastic resin, a tackifier, and a wax.

4. An apparatus for transferring toner images carried by a photoconductive layer to an image receiving sheet having an adhesion layer thereon, comprising:

moving means for moving said image receiving sheet with said adhesion layer, said adhesion layer comprising a material sensitive to one of heat and light and being adhesive only upon application of said one of heat and light, said entire adhesion layer softening and becoming adhesive only upon exposure to heat or light at a point of contact with said photoconductive layer;

transferring means for transferring a developed toner image onto said adhesion layer; and adhesive softening means for softening said adhesion layer, said developed toner image being transferred from said photoconductive layer to said image receiving sheet when said adhesion layer contacts said photoconductive layer, said adhesion layer hardening upon said developed toner image being transferred to said adhesion layer to provide a final, non-tacky substrate, wherein said adhesion layer moves at a same speed as said photoconductive layer when said adhesion layer is in contact with said photoconductive layer.

5. An apparatus as defined in claim 4, wherein said adhesive softening means comprises one of a heat and a light applying member.

6. An apparatus as defined in claim 4, wherein said adhesion softening means is provided within said transferring means.

7. An apparatus as defined in claim 4, wherein said transferring means comprises a pressure roller selectively applied to said photoconductive layer.

8. An apparatus as defined in claim 4, wherein said adhesion layer formed of a material sensitive to heat comprises a hot-melt adhesive.

9. An apparatus as defined in claim 8, wherein said hot-melt adhesive comprises a thermoplastic resin, a tackifier, and a wax.

* * * * *